US006070919A

United States Patent [19]

Finkelstein

[11] Patent Number: 6,070,919

[45] Date of Patent: Jun. 6, 2000

[54] PANEL FASTENER

[75] Inventor: Burl Finkelstein, Newnan, Ga.

[73] Assignee: Kason Industries, Inc., Shenandoah, Ga.

[21] Appl. No.: 09/372,938

[22] Filed: Aug. 12, 1999

[51] Int. Cl.[7] ..... E05C 5/00

[52] U.S. Cl. ..... 292/111; 292/241; 292/98; 403/DIG. 8; 52/127.7; 52/127.9; 52/127.11

[58] Field of Search ..... 52/127.7, 127.9, 52/127.11; 292/240–242, 95, 98, 101, 194, 202, 111; 403/DIG. 8, 231, 245

[56] References Cited

U.S. PATENT DOCUMENTS

| | | | |
|---|---|---|---|
| 2,647,287 | 8/1953 | Jones . | |
| 3,341,233 | 9/1967 | Cushman | 292/241 X |
| 3,365,223 | 1/1968 | Bisbing . | |
| 3,472,545 | 10/1969 | Berkowitz . | |
| 3,565,469 | 2/1971 | Zwart . | |
| 3,661,410 | 5/1972 | Larson et al. | 292/111 X |
| 3,671,006 | 6/1972 | Berkowitz | 249/97 |
| 3,784,240 | 1/1974 | Berkowitz | 292/111 |
| 3,851,922 | 12/1974 | McCoy | 292/111 |
| 4,392,281 | 7/1983 | Metz et al. | 292/111 X |
| 4,417,430 | 11/1983 | Loikitz | 52/584 |
| 4,507,010 | 3/1985 | Fujiya | 403/322 |
| 4,512,122 | 4/1985 | Berkowitz | 52/127.9 |
| 5,161,839 | 11/1992 | Piltingsrud et al. | 292/241 |
| 5,212,924 | 5/1993 | Finkelstein | 52/583 |
| 5,452,925 | 9/1995 | Huang | 292/57 |

*Primary Examiner*—Teri Pham

*Attorney, Agent, or Firm*—Kennedy, Davis & Hodge, LLP

[57] ABSTRACT

A panel fastener has a hook and cam assembly with a C-shaped leaf spring mounted in a recess in the camming surface of the cam. The recess is formed with a central barrier with opposed ledges on which the spring is mounted. Rotation of the cam causes the spring to frictionally engage the hook and in so doing become compressed and to flex below the recess edges without crimping.

2 Claims, 2 Drawing Sheets

PANEL FASTENER

TECHNICAL FIELD

The present invention relates generally to panel fasteners, and particularly to panel fasteners for large insulated panels like those used to form cooler room walls, floors and ceilings.

BACKGROUND OF THE INVENTION

Commercial walk-in coolers, such as those commonly found in convenience stores and commercial food storage facilities such as supermarkets, are typically constructed of insulating wall, ceiling and floor panels that are fastened together. The panel ends are shaped to fit together in tongue and groove fashion and are provided with latch type fastening means for drawing and holding adjacent panels together. The latches themselves commonly comprise a hook and cam assembly inside a casing that is mounted to one panel for latching engagement with a pin assembly inside a casing that is mounted to an adjacent panel. There are two main types of panel fasteners, nail-in-place and winged. Examples of these fasteners are shown in U.S. Pat. Nos. 3,784,240 and 3,671,006, respectively. The winged fasteners are usually mounted by being foamed in place using methods similar to the one shown in U.S. Pat. No. 5,212,924. Foam is injected inside the panel and as it hardens, the fasteners become secured in place. An undesirable side effect of the foam-in-place method is that foam often leaks into the casing of the hook. After foam hardening, it presents an obstacle to the movement of the hook.

The hook and cam assembly includes a C-shaped leaf spring that operates in a clutch like action by transferring torque from the cam to the hook. The advantage of using a C-shaped spring is that it is provides sufficiently high frictional resistance for driving the hook while also being easy to assemble by being clipped onto the cam.

During actuation of the latch, the cam turns bringing the spring into engagement with the hook. This causes the spring to shift in a direction opposite to the direction in which the hook is driven. The pressure caused by the shifting of the spring, combined with the compression of the spring, causes a significant portion of the angular flexing of the spring to occur over a very short span. This often results in the spring becoming crimped. Such crimping has been a significant and persistent problem as it weakens the resilience of the spring and reduces its frictional engagement with the hook. As a result, the spring often becomes incapable of transferring sufficient torque to re-engage the hook with the pin. This is especially true where the path of the hook is partially blocked with debris or hardened foam.

It is thus seen that a need has long existed for a panel fastener with a cam and hook assembly of the type that employs a C-shaped spring that is not susceptible to being crimped and that is capable of transferring high and consistent drive torque to the hook. Accordingly, it is the provision of such that this invention is primarily directed.

SUMMARY OF THE INVENTION

In a preferred form of the invention, a panel fastener comprises a hook having an opening defined by an inner wall, a cam with an annular camming surface rotatably received within the hook opening, and a C-shaped leaf spring interposed between the cam and the hook inner wall. The cam annular camming surface is formed with a spring mounting recess defined by two side walls, a barrier or lobe with two opposed ledges located between the two side walls, and a bottom that extends below the barrier ledges and between the two side walls and the barrier. The C-shaped leaf spring has two loop portions, two opposing end portions, and a bridge portion that bridges the two loop portions. The leaf spring is mounted in the cam spring mounting recess with the bridge portion overlaying the recess barrier and with the spring end portions upon the ledges in abutment with opposite sides of the barrier. Upon rotation of the cam within the hook opening and compression of the spring, the spring flexes below the ledges and is not crimped.

In another preferred form of the invention, a panel fastener comprises a hook having an opening defined by an inner wall, a cam with an annular camming surface rotatably received within the hook opening, and a C-shaped leaf spring interposed between the cam and the hook inner wall. The cam annular camming surface is formed with two closely adjacent spring mounting grooves each defined by a floor, a proximal side wall proximal to the other groove that is formed with a step, and a distal side wall. The C-shaped leaf spring has opposing end portions mounted upon the proximal side wall steps. Upon rotation of the cam within the hook opening and compression of the spring, the spring may flex without crimping.

DETAILED DESCRIPTION

Figure 1:
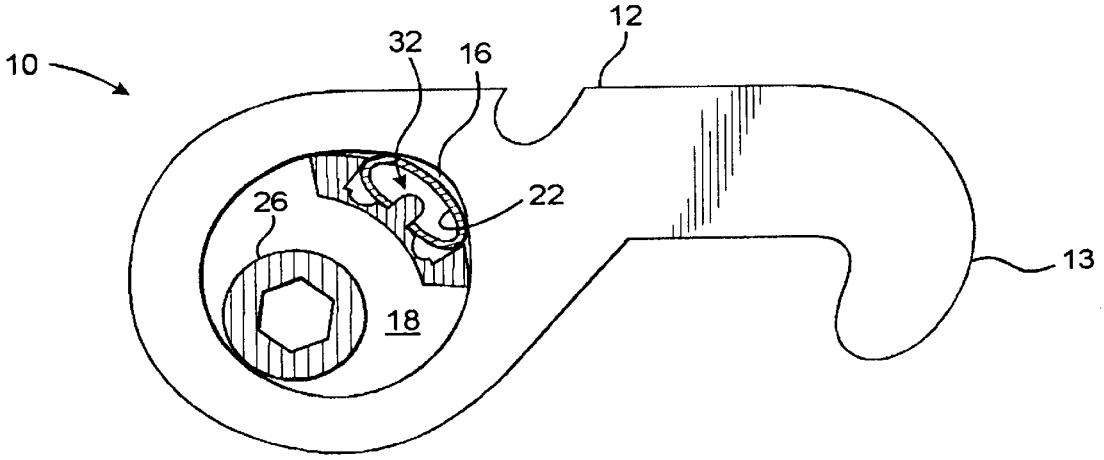
FIG. 1 is a side view of a panel fastener hook and cam assembly that embodies principles of the invention in a preferred form with its spring shown in a substantially relaxed state.
Figure 2:
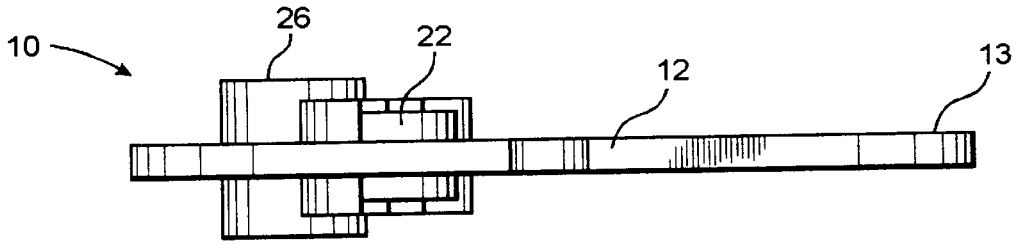
FIG. 2 is a top view of the hook and cam assembly of FIG. 1.

With reference next to the drawings, there is shown a panel fastener hook and cam assembly 10 comprising a hook 12 having an opening defined by an inner wall 16, a cam 18 with an annular camming surface 20 rotatably received within the hook opening, and a C-shaped leaf spring 22 mounted to the cam 18 adjacent the hook inner wall 16. The hook has a catch end 13 designed to engage with a pin (not shown) mounted to an adjacent panel so as to fasten the two panels together.

Figure 4:
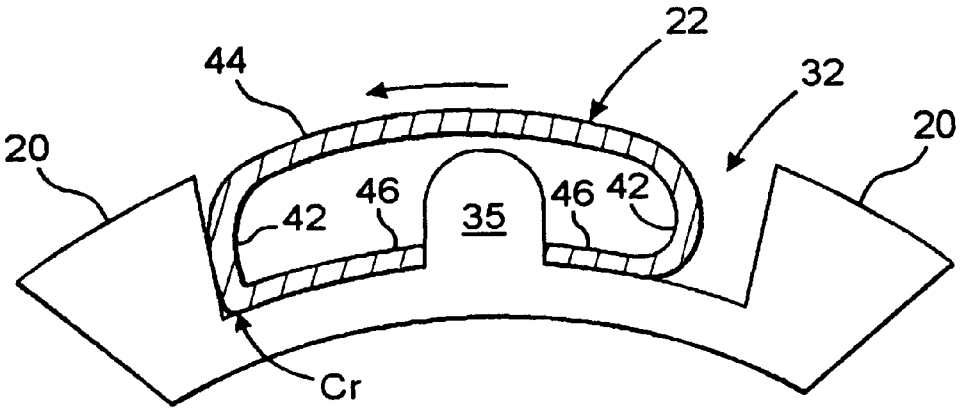
FIG. 4 PRIOR ART
FIG. 4 is an enlarged view, in part, of a hook and cam assembly of the prior art.
Figure 5:
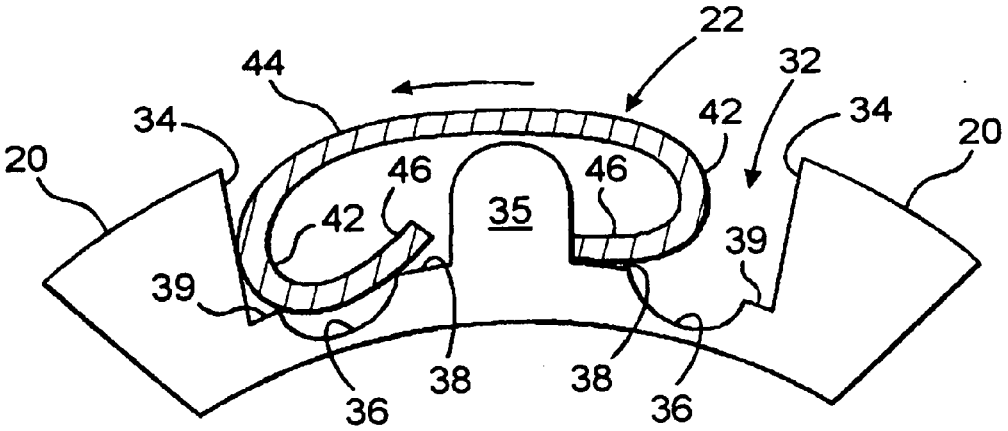
FIG. 5 is an enlarged view, in part, of the hook and cam assembly of FIG. 1.

As shown in FIGS. 1–3 and 5, the cam 18 is generally disc-shaped and has two opposite flat sides or faces from which extends a socket 26 with an axis that is offset from the axis of the cam. The cam annular camming surface 20 is formed with a spring mounting recess 32 in which the spring 22 is mounted. As best shown in FIG. 5, the recess 32 has two side walls 34, a barrier or lobe 35 located midway between the two side walls, and a floor or bottom 36. As opposed to the spring mounted recess in the prior art, shown in FIG. 4, the floor 36 is not uniformly flat. Instead, there is a step or ledge 38 on each side of the barrier 35 and a depression therebelow that extends to another step 39 that projects from each side wall 34. As is hereafter explained, this depression in the recess floor serves a very important function.

The C-shaped leaf spring 22 has two loop portions 42, a bridge portion 44 that bridges the two loop portions 42, and two opposing end portions 46. The two opposing end portions 46 are mounted upon the barrier ledges or steps 38 in abutment with the barrier 35.

Figure 3:
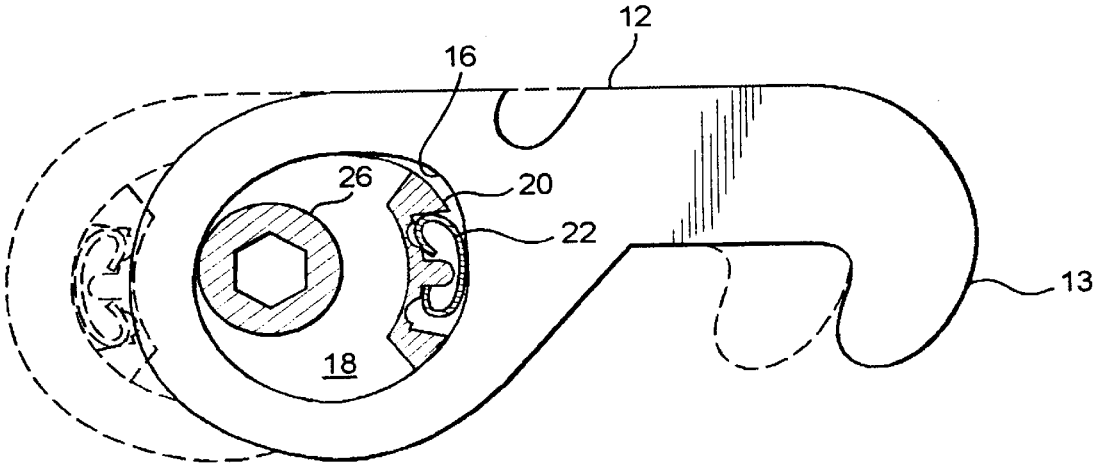
FIG. 3 is a side view of the hook and cam assembly of FIG. 1 with its spring shown in a compressed state.

As best shown in FIG. 3, the cam 18 can be turned with a socket wrench to engage the shank of the hook 12 with a pin in an adjacent panel. Further rotation of the cam 18 drives the hook to the left as shown in broken lines, bringing its catch end 13 forcefully against the pin in the adjacent panel. Rotation of the cam causes the spring 22 to be compressed. As a result, the spring 22 flexes below the barrier ledges or steps 38, as shown in FIG. 5. The rotation of the cam 18 thus causes the spring 22 to clutch the hook inner wall 16 and to drive the hook 12 causing it to engage with or disengage from the pin, depending on its direction of rotation. The flexing of the spring 22 also keeps the hook 12 restrained after engagement with the pin by imposing friction between the spring 22 and the hook inner wall 16.

As shown in FIG. 4, rotation of the cam of the prior art fastener also causes the spring to roll, as indicated by the arrow, due to the friction between its bridge portion and the hook inner wall. This applies great force on one of its ends against the barrier. This rolling force in combination with the inward radial force exerted by the hook inner wall heretofore forced the spring to bend sharply over a very short span Cr. As a result the spring would usually crimp at Cr. It is this problem which has now been overcome.

As best shown in FIG. 5, as the spring is now driven in one direction or the other, it may now flex down below the step or ledge 38. As a result the sharp bending that would have heretofore been concentrated at Cr is now spread over a substantial span of the spring loop and end portion. In this manner crimping is avoided. If desired, only one step or ledge may be formed on that side of the barrier in which crimping is most likely to occur. However, that is not preferred because of practical manufacturing and assembly considerations.

It is thus seen that a panel fastener is now provided that is substantially free of the long persistent problem of fastener hook looseness that has been found to be attributable to spring crimping. Although the invention has been shown and described in its preferred form, it should be understood that modifications and variations may be made thereto, in particular to the specific shape, size and location of the spring mounting recess floor, without departure from its spirit and scope as set forth in the following claims.

What is claimed is:

1. A panel fastener for insulated panels comprising a hook having an opening defined by an inner wall, a cam with an annular camming surface rotatably received within said hook opening, and a C-shaped leaf spring interposed between said cam and said hook inner wall, and wherein said cam annular camming surface is formed with a spring mounting recess defined by two side walls, a barrier with two opposed ledges located between said two side walls, and a bottom that extends below said barrier ledges and between said two side walls and said barrier, and wherein said C-shaped leaf spring having two loop portions, two opposing end portions, and a bridge portion that bridges said two loop portions, said C-shaped leaf spring being mounted in said cam spring mounting recess with said bridge portion overlaying said recess barrier and with said spring end portions upon said ledges in abutment with opposite sides of said barrier, whereby upon rotation of the cam within the hook opening and compression of the spring, the spring may flex below said ledges and not be crimped.

2. A panel fastener for insulated panels comprising a hook having an opening defined by an inner wall, a cam with an annular camming surface rotatably received within said hook opening, and a C-shaped leaf spring interposed between said cam and said hook inner wall, and wherein said cam annular camming surface is formed with two closely adjacent spring mounting grooves each defined by a floor with at least one step, a proximal side wall that is proximal to the other groove, and a distal side wall that is distal from the other groove, and wherein said C-shaped leaf spring has opposing end portions mounted in abutment with said proximal side walls, whereby upon rotation of the cam within the hook opening and compression of the spring, the spring may flex without crimping.

* * * * *